US006010050A

United States Patent [19]

Tarr

[11] Patent Number: 6,010,050

[45] Date of Patent: Jan. 4, 2000

[54] SHOULDER BAG BRIEFCASE

[76] Inventor: Christopher M. Tarr, 11 Greenwood Ave., Wheeling, W. Va. 26003

[21] Appl. No.: 09/301,586

[22] Filed: Apr. 29, 1999

Related U.S. Application Data

[62] Division of application No. 08/872,669, Jun. 11, 1997, abandoned

[60] Provisional application No. 60/019,898, Jun. 14, 1996.

[51] Int. Cl.[7] ..... A45C 15/00

[52] U.S. Cl. ..... 224/578; 224/609; D3/231

[58] Field of Search ..... 224/578, 575, 224/582, 609, 42.11, 257, 260, 577, 579; D3/231

[56] References Cited

U.S. PATENT DOCUMENTS

| | | | |
|---|---|---|---|
| D. 247,524 | 3/1978 | Graham | 224/42.11 |
| D. 258,098 | 2/1981 | Norinsky . | |
| 340,339 | 4/1886 | Marshall | 224/582 |
| D. 344,184 | 2/1994 | Barker . | |
| D. 365,322 | 12/1995 | Hrib . | |
| 424,324 | 3/1890 | Marshall | 224/582 |
| 501,821 | 7/1893 | Browne | 224/582 |
| 2,405,744 | 8/1946 | Glass . | |
| 2,813,602 | 11/1957 | MacArthur, Jr. . | |
| 3,970,229 | 7/1976 | Norinsky . | |

FOREIGN PATENT DOCUMENTS

| | | |
|---|---|---|
| 438870 | 12/1926 | Germany . |
| 96105 | 11/1960 | Netherlands . |
| 580343 | 10/1946 | United Kingdom . |

*Primary Examiner*—David J. Walczak
*Attorney, Agent, or Firm*—Richard C. Litman

[57] ABSTRACT

An article carrier that can be converted from a shoulder bag into a briefcase and back again. A web member functions as a strap when the article carrier is used as a shoulder bag, and as a handle when it converted for use as a briefcase. One embodiment features a web member strap that wraps about itself to form a handle for the briefcase, and unwraps to hang over a user's shoulder for the shoulder bag. In another embodiment, the user compresses the web about itself and folds it through an aperture located at the bottom of the web to form the handle. The article carrier can quickly and easily be converted from a shoulder bag into a briefcase or from a briefcase back into a shoulder bag, depending on the needs of the user.

2 Claims, 4 Drawing Sheets

SHOULDER BAG BRIEFCASE

CROSS REFERENCE TO RELATED APPLICATIONS

This application is a division of application Ser. No. 08/872,669 filed on Jun. 11, 1997, now abandon which claim the benefit of U.S. Provisional Application Ser. No. 60/019, 898 filed Jun. 14, 1996.

BACKGROUND OF THE INVENTION

1. Field of the Invention

The present invention relates generally to article carriers. More specifically, the invention relates to an article carrier that converts from a shoulder bag into a briefcase, and from a briefcase into a shoulder bag.

2. Description of the Prior Art

Many business travelers including those who simply travel to work often have two very divergent needs when it comes to carrying their business documents. The first need is for a bag-type carrier having shoulder straps. The shoulder straps allow the traveler to easily carry their documents while freeing their hands. In addition, on long trips including long commutes, especially by public transportation, the bags become heavy and burdensome and very difficult to carry by hand.

The second need business travelers have is for a briefcase type carrier having a handle close to the briefcase that they can carry by hand. When they have reached their destination, a briefcase has a more professional appearance than a bag having a shoulder strap. Although there are bags that have both a shoulder strap and a handle, when the user decides to use the handle, the strap then becomes a nuisance. Either the user must disconnect the strap and place it in the bag or allow the strap to dangle and drag along the ground. There is no bag that conveniently couples the two needs together in a bag that can be carried over the shoulder and then quickly converted into a briefcase without having to discard the strap or allow it to dangle.

Article carriers have been described in the patent literature. For example, U.S. Pat. No. 2,813,602, issued to MacArthur, Jr. on Mar. 17, 1955, discloses twin bags having a web and adapted to be slung over a suitcase so that they can be carried as a unit.

The convertible saddle brief case of U.S. Pat. No. 3,970, 229, issued to Norinsky on Jul. 20, 1976, is designed for use with a bicycle, and would therefore not be ideal for public transportation commuters. Also, U.S. Design Pat. No. Des. 258,098, issued to Norinsky on Feb. 3, 1981, U.S. Pat. No. Des. 344,184 issued to Barker on Feb. 15, 1994 and U.S. Pat. No. Des. 365,322 issued to Hrib on Dec. 19, 1995, all disclose article carriers having straps, but do not describe a convertible shoulder bag briefcase.

Netherlands Pat. No. 96,105, issued in November 1960 discloses a non-symmetrical double bag for use with a bicycle. German Pat. No. 438,870, issued on December 1926, also discloses a double bicycle bag. Furthermore, United Kingdom Pat. No. 580,343, issued on September 1946 discloses a double bag for bicycles, with a convertible handle that allows hand-carrying.

In light of the article carriers of the above inventions and patents not having shoulder bag properties, such as a strap for shoulder carrying, there is a need for an article carrier having shoulder bag properties that is quickly and easily convertible into a briefcase, and from a briefcase into a shoulder bag. There is also a need for an article carrier having a strap-handle that eliminates burdensome strap storage and strap dangling.

None of the above inventions and patents, taken either singly or in combination, is seen to describe the instant invention as claimed.

SUMMARY OF THE INVENTION

One preferred embodiment of the article carrier of the present invention includes two satchels that are connected by a specialized handle that tightly wraps about itself to urge the satchels together, whereupon they resemble a single briefcase. The handle is arched to facilitate self-wrapping, and to provide a space for a user's hand. Preferably, the satchels are dimensioned and configured to accommodate legal sized file folders. By unwrapping the handle, a user can wear the article carrier over his or her shoulder, whereupon the unwrapped handle assumes a strap-like function.

Another preferred embodiment of the present invention features a pair of satchels connected to each other by a bridge member, which comprises a web having two ends and a middle section. The web flares out from the middle section to both ends, with each end defining an elongated hole, directly above each satchel. In an uncoiled and extended position, a user places the middle section of the bridge member over his or her shoulder to carry the article carrier as a shoulder bag, allowing easy and convenient transport thereof.

However, the user of article carrier can convert the shoulder bag to a hand held article carrier by forming a handle from the middle section. The bridge member is folded upon itself, urging the satchels together, whereupon the user mates a pair of snaps disposed at each end of the elongated holes in order to secure the ends together. The elongated holes superimpose to form a unified aperture, through which the middle section is passed to form the handle, the middle section coiling upon itself through the aperture. The middle section must therefore be dimensioned to have a width less than the length of the aperture to allow the coiling and formation of the handle. To convert the article carrier back to a shoulder bag, the user first unfastens the snaps and then unfolds the bridge member, removing it from the aperture.

Accordingly, it is a principal object of the invention to provide an article carrier that converts from a shoulder bag to a briefcase and back into a shoulder bag.

It is another object of the invention to provide an article carrier having a strap that wraps upon itself to form a handle.

It is another object of the invention to facilitate quick and easy conversion of the article carrier between a shoulder bag and a briefcase.

Still another object of the invention to eliminate burdensome strap storage and strap dangling in a convertible article carrier.

It is also an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
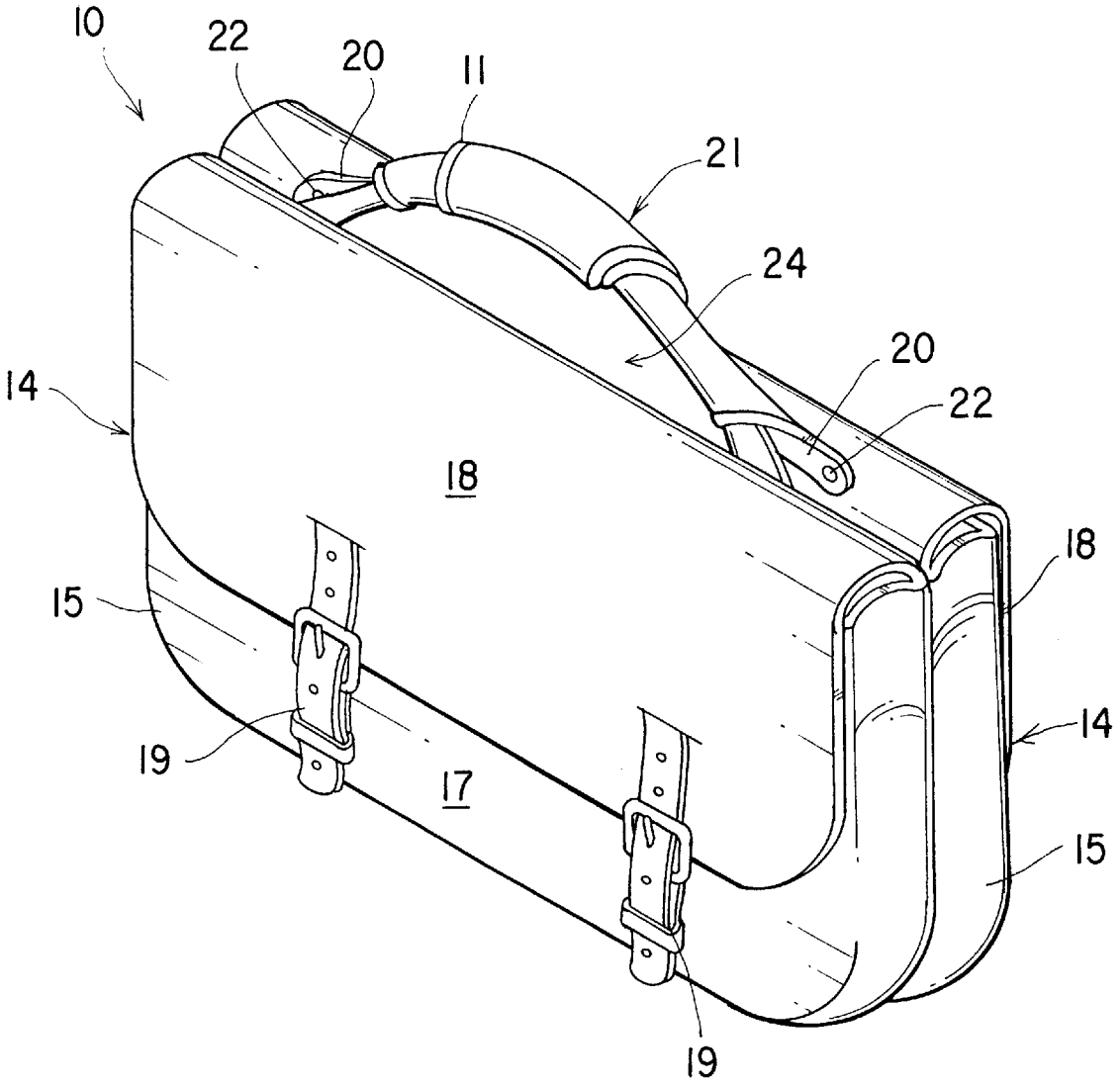
FIG. 1 is a perspective view of a preferred embodiment of the article carrier of the present invention.

FIGS. 1, 2A, 2B and 5 illustrate the preferred embodiment of the present invention. An article carrier 10 comprises a strap 11 having a first end 12 and a second end 13, each end attaching to two satchels 14. Each of satchels 14 has a body 15, with a back side 16 and a front side 17 accessed by a conventional closure flap 18. Satchels 14 are dimensioned and configured to accommodate legal sized file folders, and each flap 18 is secured by a pair of buckle closures 19. The strap 11 further comprises two bands 20 which are attached in an arc via fasteners 22 to the back side 16 of each of satchels 14 to provide a passage 24 between the band 20 and the satchel 14. The bands 20 may be integrally formed as part of strap 11. The strap 11 is dimensioned in length so as to adequately support satchels 14 on a user's shoulder when article carrier 10 serves as a shoulder bag. The shoulder bag configuration allows easy and convenient transport of article carrier 10, especially in crowded subway cars or during long commutes requiring walking or standing.

Figure 2A:
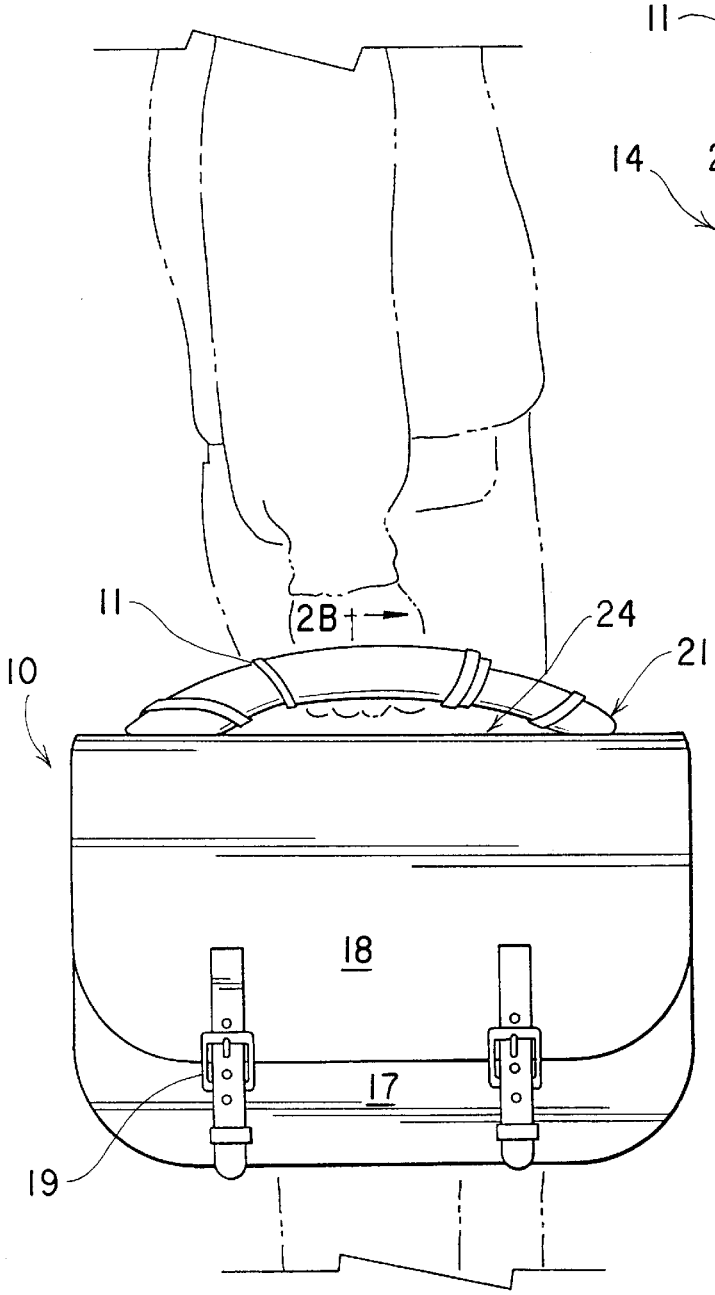
FIG. 2A is an environmental, side view of the preferred embodiment of the article carrier of the present invention, according to FIG. 1.
Figure 2B:
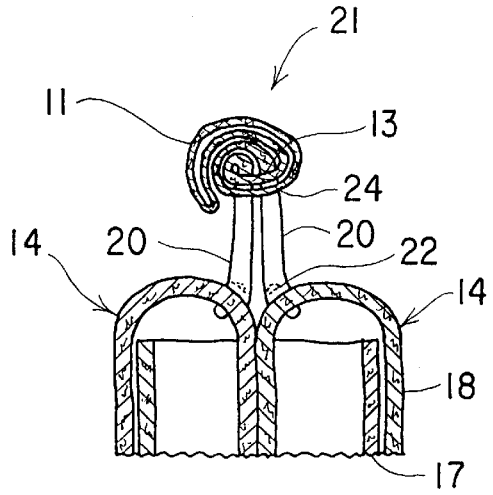
FIG. 2B is a partial, cross-sectional view of the article carrier as drawn along lines 2B—2B of FIG. 2A.

FIGS. 1 and 2A illustrate article carrier 10 in a second or wrapped state for use as a briefcase, wherein handle 21 is formed by tightly wrapping strap 11 (from FIG. 5) about itself. As can be appreciated from FIG. 2B, the user first brings satchels 14 together, so as to be back-to-back and resemble a single briefcase. The user then folds strap 11 in half, whereby ends 12,13 come together proximate to bands 20. To form handle 21, the user grasps the doubled-over folded strap 11 at its mid-point, at a twelve o'clock position relative to bands 20 and satchels 14. According to FIG. 2B, the user then pulls strap 11 in a counterclockwise direction, through the passage 24 defined by bands 20 and satchels 14. The user pulls strap 11 up over itself to ultimately overlap, thereby returning it to the twelve o'clock position, where the midpoint is a shorter distance from bands 20 and satchels 14. The user repeats the counterclockwise wrapping motion with strap 11, until no length of strap 11 remains. At this point, the user has formed handle 21, with passage 24 providing a space into which the user inserts his or her hand to grasp handle 21, as shown in FIG. 2A. The user can also wrap strap 11 in a clockwise direction, achieving the same result. The user can, without any difficulty or great expense of time, convert the shoulder bag into the briefcase or the briefcase into the shoulder bag. This allows the user to quickly, easily, and conveniently switch from one form or the other as the circumstances dictate.

Figure 3:
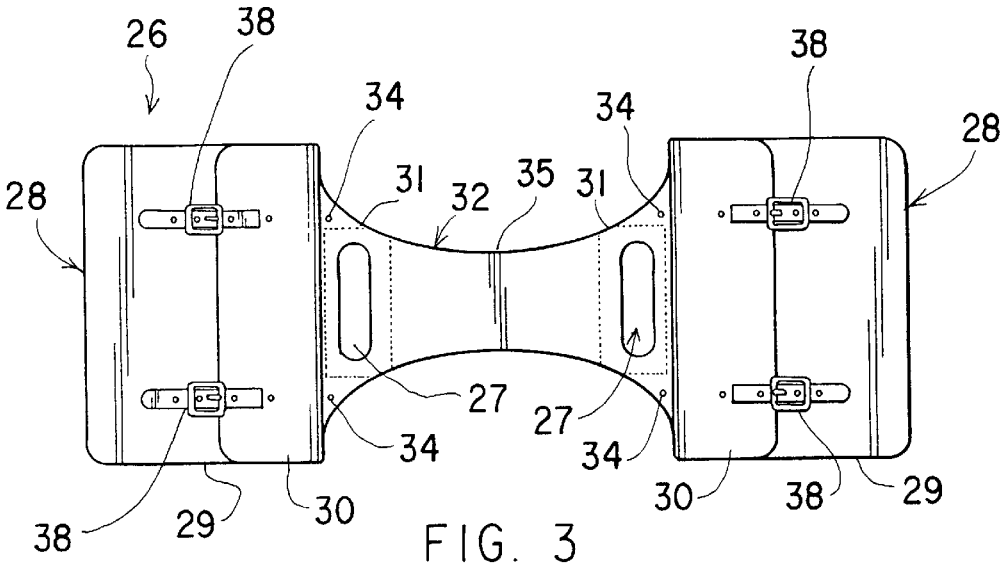
FIG. 3 is a top plan view of an alternate embodiment of the article carrier of the present invention, shown in an extended position for use as a shoulder bag.
Figure 4:
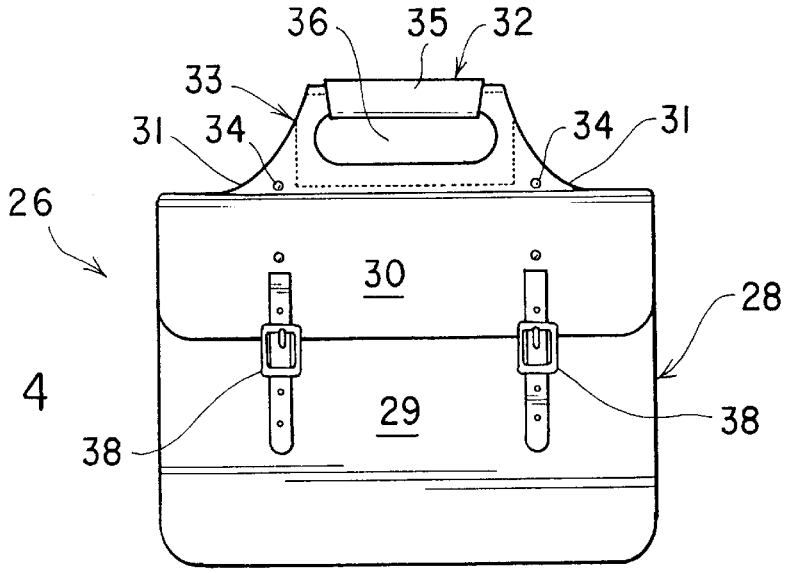
FIG. 4 is a front elevational view of the alternate embodiment of the article carrier of the present invention according to FIG. 3, shown for use as hand carried a briefcase.
Figure 5:
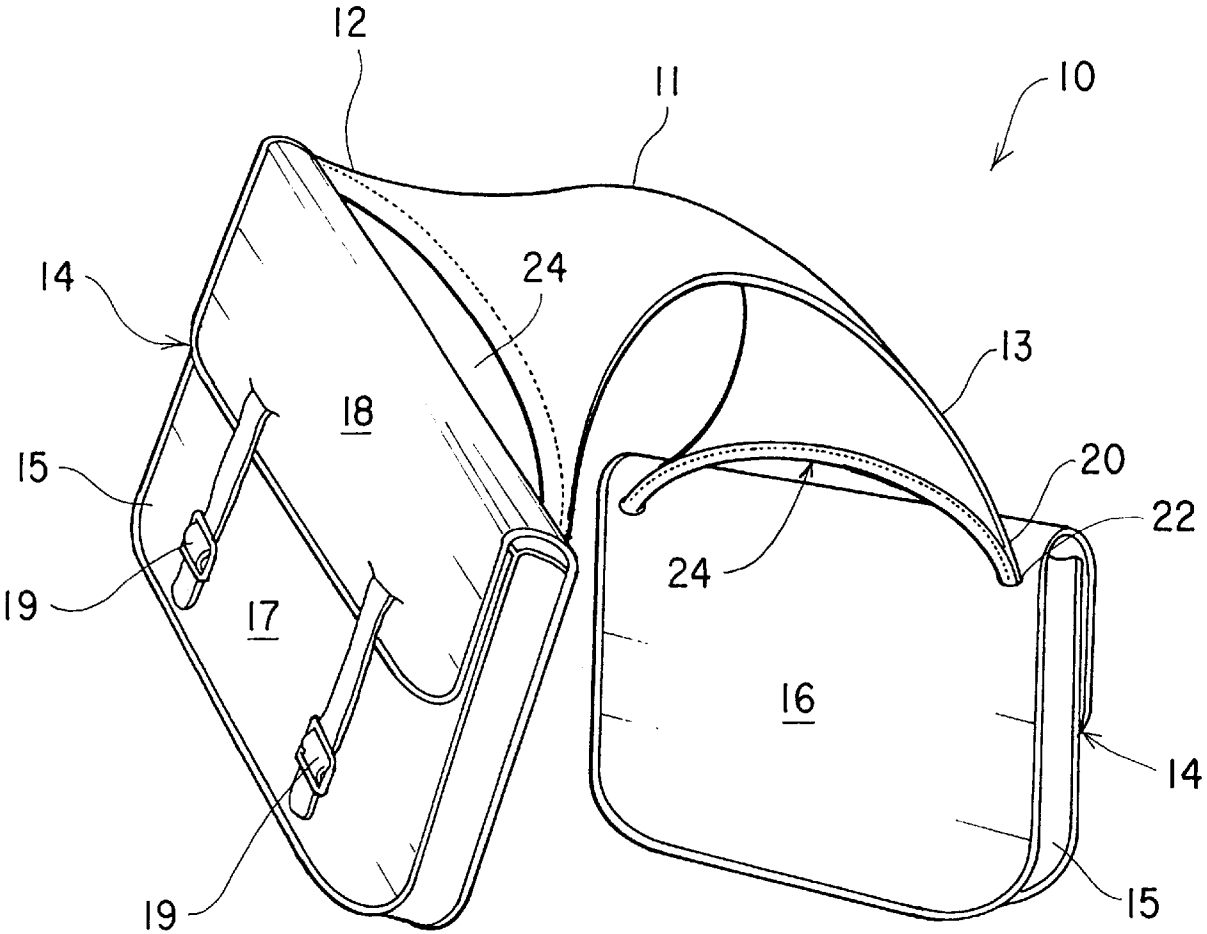
FIG. 5 is a perspective view of the preferred embodiment of the article carrier of the present invention as shown in FIG. 1, shown in an extended position for use as a shoulder bag.

Turning now to FIGS. 3 and 4, another preferred embodiment of the present invention is shown as an article carrier 26 having satchels 28 connected to each other by a bridge member 32. Each of satchels 28 comprises a body 29, a flap 30 and a pair of buckle closures 38. A user places bridge member 32 over his or her shoulder to carry article carrier 26 as a shoulder bag. This configuration allows easy and convenient transport of article carrier 26, especially in crowded subway cars or during long commutes requiring walking or standing.

Bridge member 32 comprises a web having ends 31 and a middle section 35, with the web flaring out from middle section 35 to ends 31. Ends 31 each define an elongated hole 27 proximate to each of satchels 28. Each of holes 27 is dimensioned to be slightly wider than the width of the middle section 35. These dimensions allow the user of article carrier 26 to form a handle 33, allowing the briefcase configuration shown in FIG. 4. To convert article carrier 26 for use from a shoulder bag to a briefcase, a user compresses the web of bridge member 32 on itself, bringing together satchels 28. A pair of snap assemblies 34 is provided on each of ends 31, having cooperating male and female snaps located on opposite sides of elongated holes 27 on both of ends 31. The user mates snaps 34 on ends 31 to secure ends 31 together. When the user compresses bridge member 32 on itself, elongated holes 27 superimpose to form aperture 36, as shown in FIG. 4. The user then coils bridge member 32 about itself through aperture 36 to form handle 33, as holes 27 comprising aperture 36 are wider than middle section 35, and can accordingly accommodate passage of the middle section 35 therethrough. A predetermined size and shape of aperture 36 facilitates the formation of a comfortable hand grip for handle 33.

To convert article carrier 26 back to a shoulder bag, the user unfolds bridge member 32 and removes it from aperture 36, then unfastens snaps 34. The user can, with out any difficulty or great expense of time, convert the shoulder bag into the briefcase or the briefcase into the shoulder bag. This allows the user to quickly, easily, and conveniently switch from one form or the other as the circumstances dictate.

It is to be understood that the present invention is not limited to the embodiments described above, but encompasses any and all embodiments within the scope of the following claims.

I claim:

1. An article carrier comprising:

a first satchel and a second satchel;

a bridge member connecting said first and second satchels, said bridge member comprising a web having a first end portion, a second end portion and a middle section therebetween, said middle section having a predetermined width and a predetermined length to permit said web to be hung over a shoulder of a user and thereby suspend said first satchel and said second satchel, said first end portion and said second end portion each having a width greater than said predetermined width of said middle section and each defining a concave arced edge across said width thereby defining an arced band associated with each said first and second end portions, wherein said arced band is connected to an associated satchel so as to define an elongated passage beneath said concave arced edge and between said band and said associated satchel;

whereby said middle section may be wrapped about itself and pass repeatedly through said passage so as to form a handle for carrying said satchels.

2. The article carrier according to claim 1, wherein said first and second satchels are dimensioned and configured to accommodate legal sized file folders.

* * * * *